US011459784B2

(12) United States Patent
Paolucci

(10) Patent No.: US 11,459,784 B2
(45) Date of Patent: Oct. 4, 2022

(54) ANCHOR DISC DEVICE

(71) Applicant: Frederick Joseph Paolucci, North Providence, RI (US)

(72) Inventor: Frederick Joseph Paolucci, North Providence, RI (US)

( * ) Notice: Subject to any disclaimer, the term of this patent is extended or adjusted under 35 U.S.C. 154(b) by 0 days.

(21) Appl. No.: 17/149,999

(22) Filed: Jan. 15, 2021

(65) Prior Publication Data

US 2021/0230897 A1 Jul. 29, 2021

Related U.S. Application Data

(60) Provisional application No. 62/965,211, filed on Jan. 24, 2020.

(51) Int. Cl.
*E04H 12/22* (2006.01)
*A45B 23/00* (2006.01)

(52) U.S. Cl.
CPC ..... *E04H 12/2215* (2013.01); *A45B 23/00* (2013.01); *E04H 12/2269* (2013.01); *A45B 2023/0012* (2013.01)

(58) Field of Classification Search
CPC . E04H 12/2215; E04H 12/2269; A45B 23/00; A45B 2023/0012; A45B 2200/109
USPC ..... 248/523, 529, 530, 125.8, 121, 156
See application file for complete search history.

(56) References Cited

U.S. PATENT DOCUMENTS 2,275,870 A * 3/1942 Sheldon ..... F41B 5/06 124/25.7
4,269,010 A * 5/1981 Glass ..... E04H 17/08 52/154
4,700,420 A 10/1987 Belanger
4,972,642 A 11/1990 Strobl, Jr.
5,105,493 A 4/1992 Lugtenaar
5,165,663 A * 11/1992 Wells ..... E04H 12/2269 52/165
5,482,071 A 1/1996 Liu
5,524,855 A 6/1996 Lesar
D371,901 S 7/1996 Perls
5,535,978 A 7/1996 Rodriguez et al.
6,113,054 A * 9/2000 Ma ..... E04H 12/2238 248/910
6,328,046 B2 12/2001 Doreste
6,354,554 B1 3/2002 Hollenbeck
6,471,176 B2 * 10/2002 Berthiaume ..... E04H 12/2269 248/529
6,715,503 B2 4/2004 Brooks, III
7,219,382 B2 5/2007 Johnson (Continued)

*Primary Examiner* — Muhammad Ijaz
(74) *Attorney, Agent, or Firm* — Barlow, Josephs & Holmes, Ltd.; David R. Josephs

(57) ABSTRACT

The anchor disc device supports and anchors an umbrella and includes a tube post to receive the free end of the pole of a beach umbrella with an anchor disc portion attached to the free end of the tube post. An end cap is installed in the free end of an extension of the anchor disc portion. The anchor disc portion includes an outwardly extending flange for engagement with sand into which the device is buried to help avoid disengagement of the umbrella from the sand from wind and the like. For removal, the umbrella is rotated in large circular motions to form a cone-shaped hole after which the umbrella and connected anchor disc device can be removed. The anchor disc device can then be detached from the umbrella, if desired.

3 Claims, 7 Drawing Sheets

(56) References Cited

U.S. PATENT DOCUMENTS

| | | | | |
|---|---|---|---|---|
| 7,406,975 | B1 | 8/2008 | Carrier, Jr. | |
| D606,776 | S | 12/2009 | Zubyk | |
| 7,694,487 | B1 * | 4/2010 | Ryan | E04H 12/2269 52/297 |
| 7,930,859 | B1 * | 4/2011 | Eslambolchi | E04H 12/2269 40/607.1 |
| D652,615 | S | 1/2012 | Paolucci | |
| 9,285,076 | B2 | 3/2016 | Paolucci | |
| 2004/0163336 | A1 * | 8/2004 | Hsu | E04H 12/2223 52/157 |
| 2007/0204891 | A1 | 9/2007 | Zubyk | |
| 2009/0020145 | A1 | 1/2009 | Zubyk | |
| 2012/0042915 | A1 | 2/2012 | Dorr | |
| 2013/0037066 | A1 | 2/2013 | Dorr | |
| 2020/0131795 | A1 * | 4/2020 | Worm | A45B 23/00 |

* cited by examiner

ANCHOR DISC DEVICE

CROSS REFERENCE TO RELATED APPLICATION

This application claims priority to earlier flied U.S. Provisional patent Application No. 62/965,211, filed on Jan. 24, 2020, the entire contents of which are incorporated herein by reference.

BACKGROUND OF THE INVENTION

The present invention relates to anchor devices for supporting and securing objects, such as umbrellas. More specifically, the present invention relates to securing such objects into sand, such as that found at the beach and other locations.

It is very well known in the art to secure objects into sand so that they may be secured in place. For example, it is very common in the art to secure an umbrella in sand by including a pointed stake on the free end of the umbrella post and then driving that pointed end into the sand as much as possible. However, a pointed end is susceptible to being pulled out easily, particularly when there are strong winds that can pull up on the umbrella to remove it from the sand. Also, it has been known to drill a deep hole, such as 32 inches, to receive the direct cylindrical and smooth standard umbrella post. In such a case, the umbrella must carefully be installed and preferably facing the wind direction to help prevent the umbrella from being dislodged upon a sudden gust of wind or a steady wind.

It is also very well known to provide weights on a base of an umbrella to hold it in place. This solution suffers from the drawback of being heavy and difficult to transport and is still susceptible to being tipped over.

Still further, there are known anchor systems that help safely secure an umbrella in unstable ground, such as sand. However, they are installed first and then buried in sand and are devoid of a way to easy remove the anchor device, thereby requiring the anchor device to be dug out so it can be removed. This requires labor on the part of the user to simply remove the anchor device when it is no longer needed and needs to be transported.

The above attempts in the prior art fail to solve the above-mentioned problems.

In view of the foregoing, there is a demand for an anchor device that is lightweight yet easy to use yet still effectively anchors an umbrella in sand, even in the presence of strong winds. There is also a demand for an anchor device that can be easily removed from the sand without first being dug up by the user.

SUMMARY OF THE INVENTION

The present invention preserves the advantages of prior art anchor devices and, particularly, anchor devices for beach umbrellas. In addition, it provides new advantages not found in currently available devices and overcomes many disadvantages of such currently available devices.

The present invention is directed to a new and novel anchor disc device for supporting and anchoring an umbrella and improved method of securing a beach umbrella using the anchor disc device of the present invention. The anchor disc device includes a tube post to receive the free end of the pole of a beach umbrella. An anchor disc is attached to the free end of the tube post. An end cap is installed in the free end of an extension of the anchor disc member. The anchor disc portion includes an outwardly extending flange for engagement with sand into which the device is buried to help avoid disengagement of the umbrella from the sand from wind and the like. Thus, the anchor disc is fully buriable and the tube post member is partially buriable in sand after being fully installed to carry out its unique anchoring capabilities.

When an umbrella, that is fitted with the anchor disc device of the present invention, is no longer needed to be secured into the sand, it is easily removed from the sand by rotating the umbrella in large circular motions to form a cone-shaped hole after which the umbrella can be removed and anchor disc device can then be detached from the umbrella, if desired.

Therefore, an object of the invention is to provide an anchor device that is lightweight yet easy to use yet still effectively anchors an umbrella in sand, even with strong winds.

Another object of the invention is to provide an anchor device that can be easily removed from the sand without first being fully dug up by the user.

Yet another object of the present invention is to provide an anchor device that has no moving parts and is easy to attach and detach from an umbrella.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DESCRIPTION OF THE INVENTION

Figure 1:
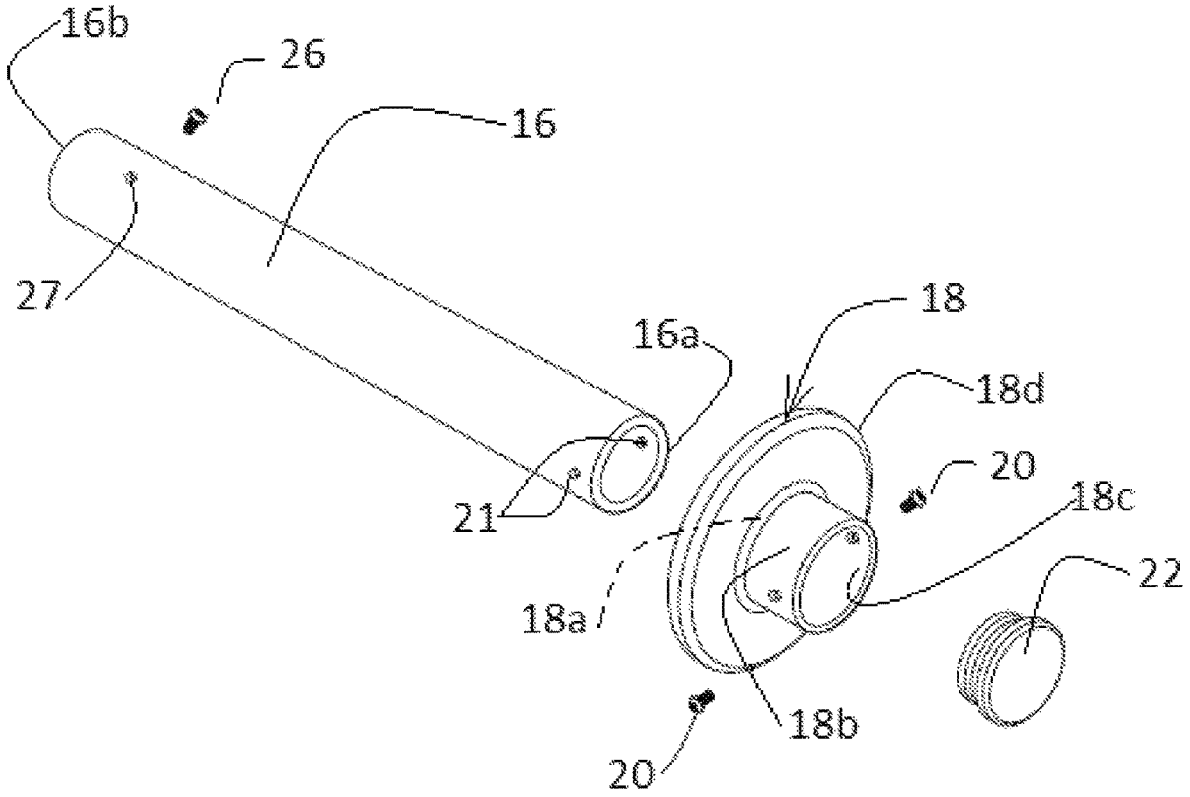
FIG. 1 is an exploded perspective view of the anchor disc device of the present invention.
Figure 2:
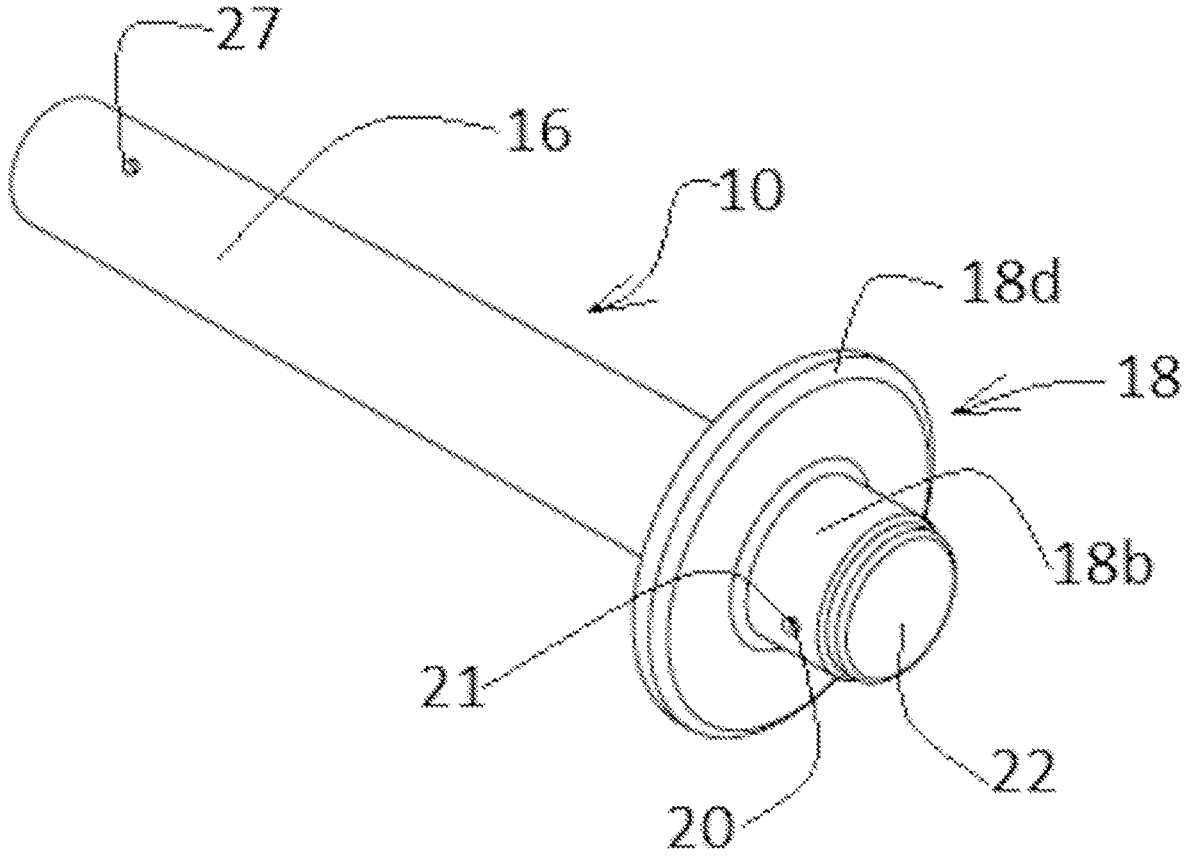
FIG. 2 is a perspective view of the anchor disc device of FIG. 1 in assembled form.
Figure 3A:
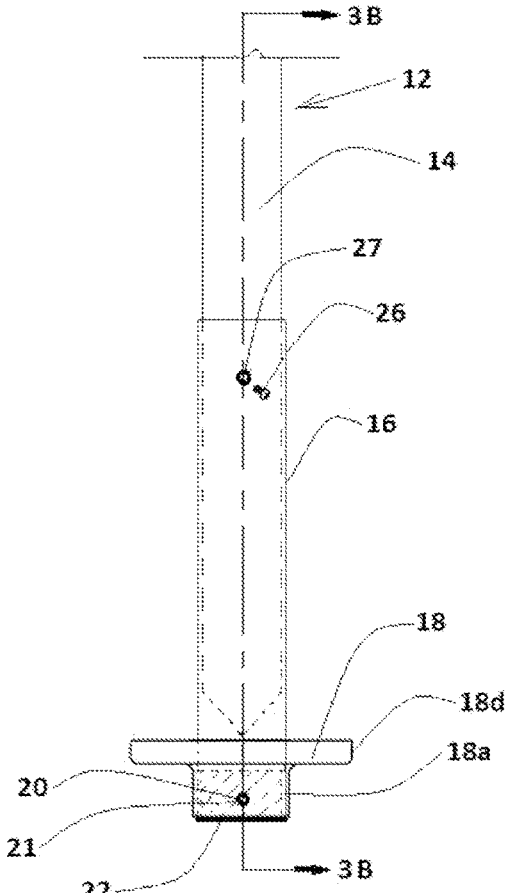
FIG. 3A is a partial side cross-section view of an umbrella post installed and secured to the anchor disc device.
Figure 3B:
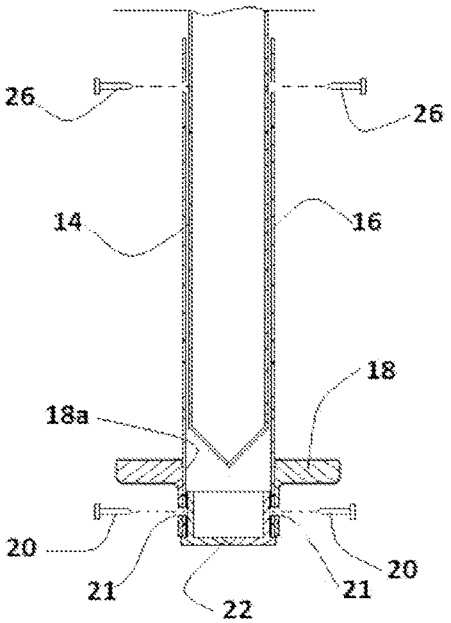
FIG. 3B is a cross-sectional view through the line 3B-3B of FIG. 3A.

The present invention is directed to a new and novel anchor disc device 10 for supporting and anchoring an umbrella 12 and improved method of securing a beach umbrella 12 using the anchor disc device 10 of the present invention. Referring to FIGS. 1-3, the assembly of the anchor disc device 10 and receipt of an umbrella post 14 therein is shown in detail. First, in FIG. 1, an exploded perspective view of the anchor disc device 10 of the present invention is shown to include a tube post 16, that is hollow, to receive the free end of a post 14 of a beach umbrella 12, as seen in FIG. 3 below. The anchor disc device 10 includes an anchor disc portion 18 that is attached to the free end 16*a* of the tube post 16. The free end 16 a of the tube post 16 is inserted into an open top end 18*a* of the anchor disc portion 18 and then fastened in place using fasteners 20, such as two screws, which are preferably stainless steel, as seen in FIGS. 1 and 2, for example, through an extension portion 18*b* via holes 21 of the anchor disc portion 18. The screws 20 may also be self-tapping. While the use of such two screws 20 is preferably used, other ways to secure the tube post 16 and the anchor disc portion 18 to each may be used. For example, the tube post 16 and the anchor disc 18 may be welded to each other. The extension portion 18*b* is also preferably hollow. As seen in FIGS. 3A and 3B, an end cap 22 is preferably press fit installed into communication with the free open end of tube 16 via opening 18*c* of the extension 18*b* of the anchor disc portion 18 and is also secured by the stainless steel screws 20 that secures the tube post 16 via holes 21 to the anchor disc portion 18. The two self-tapping screws 20, both install through the anchor disc 18 into the tube 16 and cap 22, as shown in FIGS. 3A and 3B.

Thus, FIG. 2 shows a completely assembled anchor disc device 10 of the present invention, which is ready for receipt of a post 14 of an umbrella 12 for anchoring it into sand 24, as will be described in detail below.

FIG. 3A shows a side view of the anchor disc device 10 with an umbrella post 14 slidably inserted into the top open end 16*b* of the tube post 16 and FIG. 3B shows a cross-sectional view through the line 3B-3B of FIG. 3. Tube post 16 slides into hole 18*a* in the anchor disc and then the cap 22 installs into the open end 16*a* of the tube via open end 18*c* of the anchor disc 18. The complete umbrella assembly is not shown for ease of illustration but it can be readily understood that the umbrella post 14 extends upwardly to the usual expanding umbrella configuration and assembly. Such an umbrella assembly is so well known that it need not be shown herein. With the umbrella post 14 inserted downwardly into the tube post 16, it is preferably secured in place to the anchor disc device 10 using preferably two set screws 26 through holes 27, one of each side, as can be seen in FIGS. 3A and 3B. Such set screws 26 are just one way of securing the anchor disc device 10 to an umbrella post 14 but many other ways may be used for this purpose.

Figure 4:
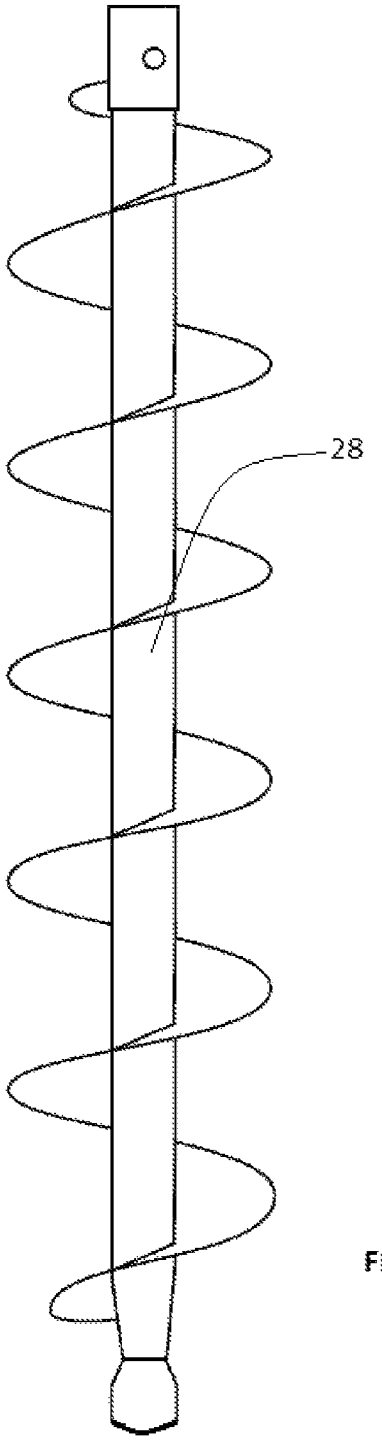
FIG. 4 is a side view of an auger for drilling a hole in the sand for receipt of the anchor disc device with umbrella installed therein.
Figure 5:
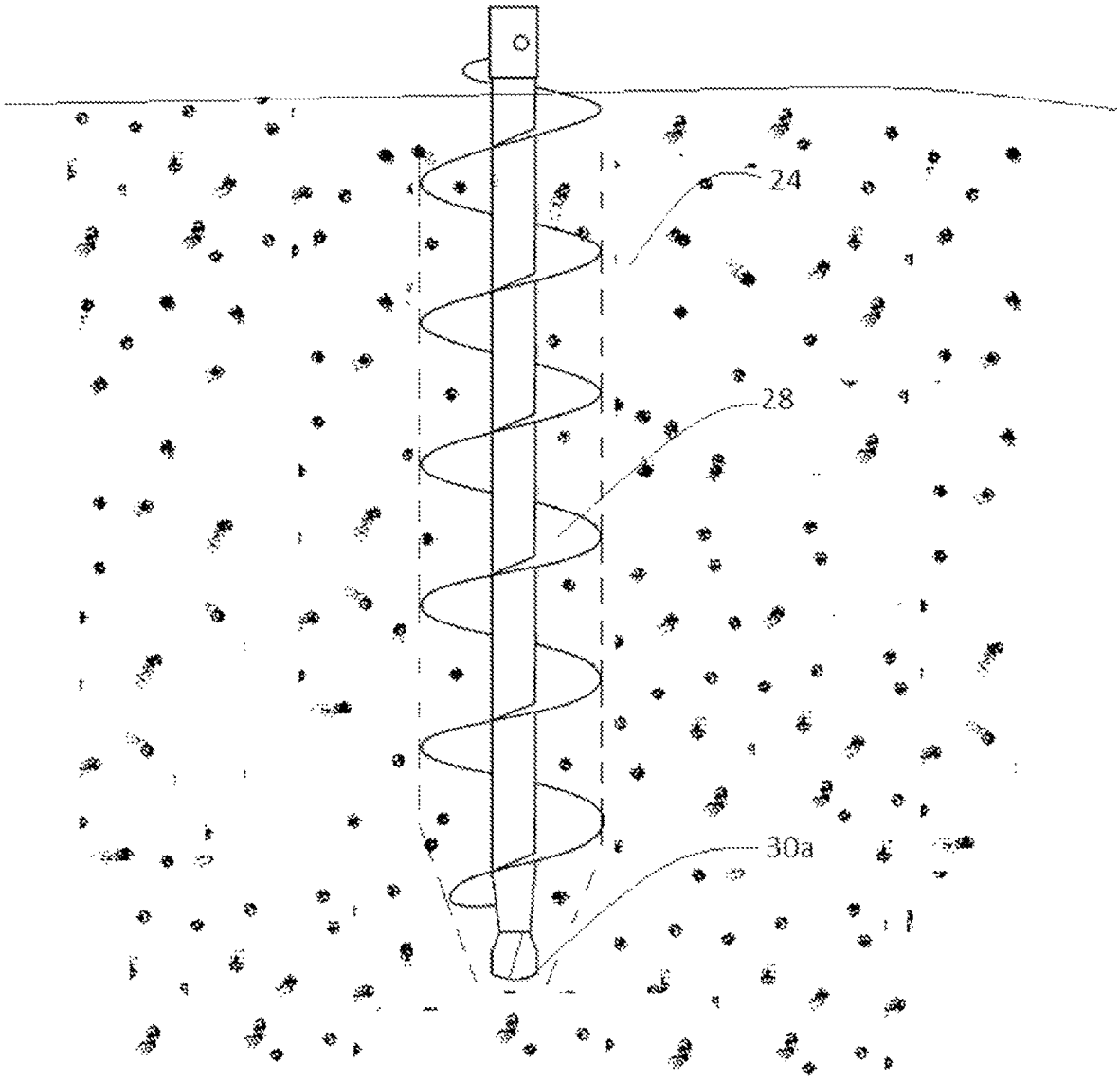
FIG. 5 is a side partial cross-sectional view of a hole in the process of being dug in sand by an auger in preparation for installation of a beach umbrella.
Figure 6:
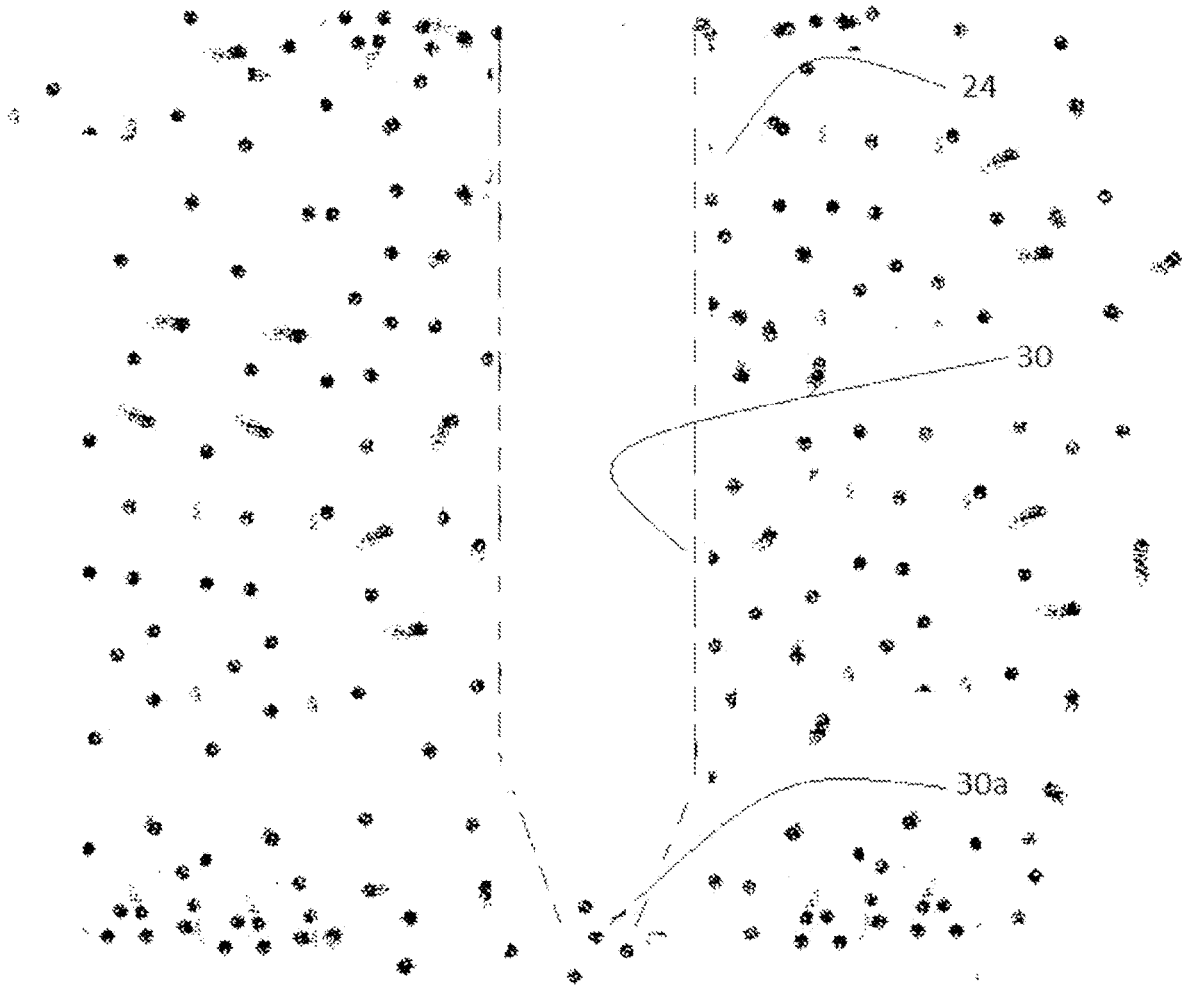
FIG. 6 is a side partial cross-sectional view of a hole formed in sand by the auger shown in FIG. 3, with sand now removed in preparation for installation of a beach umbrella, equipped with the anchor disc device of the present invention, into the hole that was formed.
Figure 7:
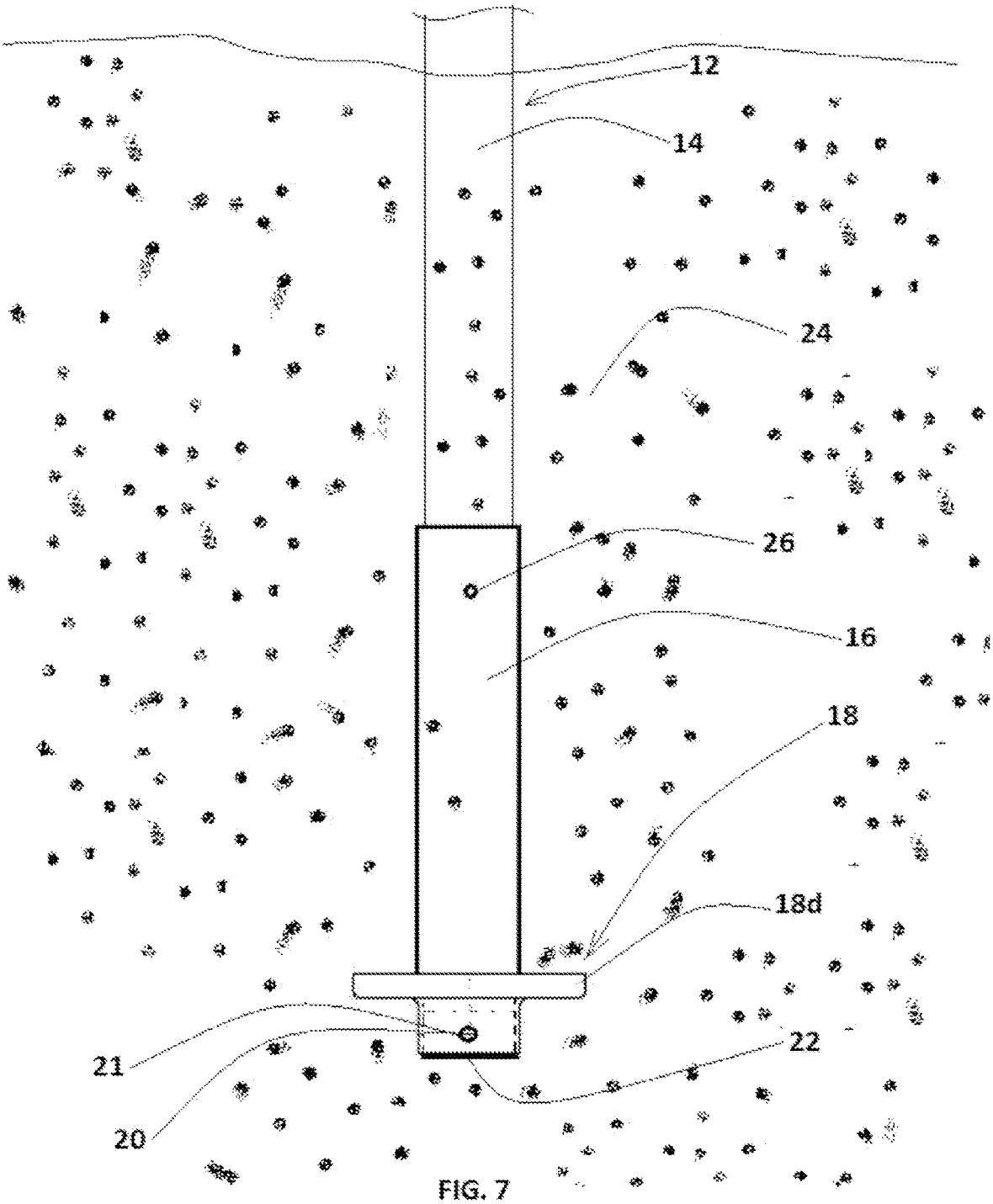
FIG. 7 is side partial cross-sectional view of the free end of a beach umbrella, with the anchor disc device installed on the free end thereof, being buried in the sand and ready for use.

FIG. 4 shows a side view of an auger 28 that is used to drill a hole 30 in sand for receipt of the anchor disc device 10 of the present invention with an umbrella post 14 installed therein. Preferably, the auger 28 of FIG. 4 is 4 inches in diameter and is powered by a hand drill (not shown), or the like. To create the necessary hole 30 in the sand, the auger 28 is used to drill out the sand 24 with a preferred approximate 4-inch diameter to a depth of 20-24 inches, as can be seen in FIG. 5, to leave a hole 30 behind, as seen in FIG. 6, with a bottom 30*a*. Then, the anchor disc device 10, with umbrella post 14 already installed therein are both inserted into the newly created hole 30 in the sand. As seen in FIG. 7, sand, preferably 30 to 50 pounds of sand, are back filled in the hold and about the anchor disc device 10 (and umbrella post 14 installed therein) to thereby secure the entire umbrella structure in place.

As can be seen in FIG. 7, which shows the anchor disc device 10 and umbrella secured in the sand, the anchor disc portion 18 includes an outwardly extending flange 18*d* for engagement with sand 24 into which the device 10 is buried to help avoid disengagement of the umbrella from the sand 24 from wind and the like. The flange-like structure 18*d* of the anchor disc portion 18 within the sand 24 provides resistance to upward pulling forces from wind and the like, which could undesirably pull out the umbrella from the sand 24. With the present invention, the anchor disc portion 18 and its flange member 18*d* are fully buried and the tube post 16 is partially buried in sand 24 after being fully installed. Thus, an umbrella post equipped with the anchor disc device 10 of the present invention has greatly improved anchoring over umbrellas with direct buried posts as well as prior art umbrella anchors.

When an umbrella, that is fitted with the anchor disc device 10 of the present invention, is no longer needed to be secured into the sand 24, it is easily removed from the sand 24 by rotating the umbrella in large circular motions to form a cone-shaped hole after which the umbrella and anchor disc device attached thereto can be removed. The anchor disc device 10 can then be detached from the umbrella, if desired, by removing or loosening the two set screws.

The present invention is preferably made of corrosion resistance metal materials for durability and strength but any suitable material can be used, such as reinforced plastics.

It would be appreciated by those skilled in the art that various changes and modifications can be made to the illustrated embodiments without departing from the spirit of the present invention. All such modifications and changes are intended to be covered by the appended claims.

What is claimed is:

1. An anchor disc device for supporting an umbrella in sand, comprising:

a tube post having a top open end and a bottom open end and being hollow; the top open end being configured and arranged for slidable receipt of an umbrella post therein;

an anchor disc portion directly connected to the bottom open end of the tube post; the anchor disc portion including main body and a circumferential flange extending laterally outward therefrom; the anchor disc portion having a top open end and a bottom open end and being hollow; the anchor disc portion being slidably received over the bottom open end of the tube post; the bottom open end of the tube post and the bottom open end of the anchor disc being aligned with each other;

an end cap residing in and sealing the bottom open end of the tube post the end cap, tube post and the anchor disc being secured to each other; a portion of the tube post, a portion of the anchor disc portion the end cap residing below the circumferential flange;

the anchor disc device, including its circumferential flange, being completely buriable in the sand beneath a top surface of the sand and being resistant to unwanted removal due to external forces.

2. The anchor disc device of claim 1, wherein the tube post and anchor disc portion are made of corrosion-resistant metal or plastic.

3. The anchor disc device of claim 1, wherein the tube post is configured and arranged to securely receive the umbrella post via at least one set screw.

* * * * *